US011745032B2

(12) United States Patent
Cardona

(10) Patent No.: US 11,745,032 B2
(45) Date of Patent: Sep. 5, 2023

(54) DETACHABLE THRUST DEVICE FOR OPENING A DOOR

(71) Applicant: LIBERVIT, Perpignan (FR)

(72) Inventor: Yvan Cardona, Bompas (FR)

(73) Assignee: LIBERVIT, Perpignan (FR)

( * ) Notice: Subject to any disclaimer, the term of this patent is extended or adjusted under 35 U.S.C. 154(b) by 114 days.

(21) Appl. No.: 17/260,005

(22) PCT Filed: Jul. 8, 2019

(86) PCT No.: PCT/FR2019/051690

§ 371 (c)(1),
(2) Date: Jan. 13, 2021

(87) PCT Pub. No.: WO2020/016500

PCT Pub. Date: Jan. 23, 2020

(65) Prior Publication Data

US 2021/0322795 A1 Oct. 21, 2021

(30) Foreign Application Priority Data

Jul. 17, 2018 (FR) ..... 1856589

(51) Int. Cl.
*A62B 3/00* (2006.01)

(52) U.S. Cl.
CPC ..... *A62B 3/005* (2013.01)

(58) Field of Classification Search
CPC ..... A62B 3/005
USPC ..... 254/93 r, 89 h; 29/239; 16/244; 248/177.1
See application file for complete search history.

(56) References Cited

U.S. PATENT DOCUMENTS

| | | | | |
|---|---|---|---|---|
| 6,916,013 | B2 * | 7/2005 | Cardona | A62B 3/005 254/89 H |
| 8,746,659 | B2 | 6/2014 | Cardona | |
| 2004/0149969 | A1 | 8/2004 | Cardona | |
| 2012/0119174 | A1 | 5/2012 | Cardona | |

FOREIGN PATENT DOCUMENTS

| | | | |
|---|---|---|---|
| CN | 2817910 | Y | 9/2006 |
| CN | 206588997 | U | 10/2017 |
| FR | 2825354 | A1 | 12/2002 |
| FR | 2944709 | A1 | 10/2010 |
| FR | 2983736 | A1 | 6/2013 |
| GB | 2236803 | A | 4/1991 |
| WO | 2010125263 | A1 | 11/2010 |

OTHER PUBLICATIONS

International Search Report and Written Opinion from PCT Application No. PCT/FR2019/051690, dated Dec. 19, 2019.
Search Report and Written Opinion from corresponding FR Application No. FR 1856589, dated May 8, 2019.

* cited by examiner

*Primary Examiner* — Don M Anderson
*Assistant Examiner* — Caleb Andrew Holizna
(74) *Attorney, Agent, or Firm* — WORKMAN NYDEGGER

(57) ABSTRACT

A thrust device for opening a door which can be assembled from a ready-to-assemble assembly of at least three parts by reversible attachment devices, which can be manually activated and deactivated, and able to maintain a rectilinear alignment of the lower and upper parts of the lower and upper support bars.

14 Claims, 10 Drawing Sheets

DETACHABLE THRUST DEVICE FOR OPENING A DOOR

BACKGROUND

The present invention relates to a thrust device for opening a door by pushing a door, able to exert a thrust on the vertical surface of the door and force it open. The present invention also relates to a method for exerting a thrust, preferably of at least 50 kN, on a door or other flat vertical surface, from external anchorages.

More particularly, the invention relates to a device for accomplishing the opening as rapidly as possible based on an assembly of at least three ready-to-assemble parts, strongly, without shock and silently, of any type of residential, industrial facility or other door.

These devices are intended to be used mainly either by rescue organizations such as firefighters or civil defense, or by special police or gendarmerie units or even special units of the army, and intended particularly to accomplish the opening of reinforced residential doors.

Already known from FR 2 825 354 and FR 2 944 709 is a device for exerting a thrust on the vertical surface of a door to accomplish opening by forcing open said door. These devices are perfectly suited for the opening of doors opening by pushing or by pulling, from the face of said door where the thrust or the traction on said door must be exerted on said door to open it. These devices operate by thrust on the door thanks to anchorages at three levels, namely on the ground, on the central part of the door panel, where the forcing of the door is exerted, and on the upper part or lintel of the retention and abutment door frame, where the direct thrust from a jack is exerted.

These prior devices comprise:

a lower support bar consisting of a jack, preferably hydraulic, an intermediate sole and an upper support bar, said jack comprising a jack body, of which one end is attached in an articulated manner, preferably in a detachable manner, to a lower support sole on the ground, and a movable rod of which one end is attached in an articulated manner, preferably in a detachable manner, to said intermediate support sole on the door, and said upper support bar being attached in an articulated manner, more preferably in a detachable manner, at one of its ends to said intermediate sole.

The articulation of the end of the movable rod of said jack on said intermediate sole allows disposing it with an inclination, preferably of 20 to 35° relative to the vertical, so as to be able to exert a thrust, preferably of at least 50 kN, on said intermediate sole when said intermediate sole is applied supported on said door or flat vertical surface and said jack is supported on a lower external anchorage, preferably on the ground.

Likewise, the articulation of said upper support bar on said intermediate sole allows disposing said bar substantially vertically so as to be able to apply its free end directly supported by an upper external anchorage preferably consisting of the frame of said door or a ceiling, or a flat horizontal surface situated above said flat vertical surface. What is meant here by "free end" is the end of said bar which is not attached to said intermediate sole.

The device of FR 2 825 354 is perfectly suited for opening doors which open by pushing on the side where the thrust device is situated on the door, i.e. doors called "push" doors opening toward the interior of the room, from the exterior of which it is desired to open it. In practice, the device operates on push doors thanks to its support at three levels, namely:

the ground, on the door and, on the upper part or lintel of the retention and abutment door frame.

In fact, the upper end of the upper support bar comes into abutment below and against the part of the lintel of the door frame protruding relative to the vertical plane of the surface of the door and against which the upper end of the door comes into abutment. This part of the lintel situated lower than the upper end of the door actually ensures the retention of the door in its frame, when the door is closed by pulling it.

FR 2 944 709 supplies a device for thrusting on a door with a flat vertical surface suited for a pulling door, i.e. one which it is desired to open from the outside, the retaining belt of the door frame being situated on the inside. This device for opening a door by forcing it open, able to exert a thrust on the vertical surface of the door and force it open, when the device is positions against the door on the side where it opens by pulling it, comprises an upper support device attached in an articulated manner, preferably in a detachable manner, to the upper end of said upper support bar, said upper support device comprising at least one spacing and blocking part able to allow the articulation in rotation of said spacing and blocking part relative to the upper end of said upper support bar. Said spacing and blocking part thus provides the same technical effect as the part of the lintel protruding relative to the vertical plane of the door serving as an abutment, in a door opening device deprived of this blocking and spacing device at the upper end of the upper support bar, when the door opening device is situated on the side where the door opens by pushing.

It is understood that the terms "upper"/"lower" and "above"/"below" refer to two opposite orientations in the longitudinal directions of the support bars, when the device is in position to exert a thrust on a vertical surface.

The jack is intended to be supported on the ground, but could also be supported on an external lower anchorage. Likewise, the intermediate sole is intended to be supported on the door, but could be supported on a median external anchorage.

What is meant here by "in an articulated manner" is that the two parts attached to one another can pivot relative to one another at least around a horizontal axis when the longitudinal direction of said lower support bar and upper support bar are situated in the same vertical plane.

The devices described in these two prior patents are not optimally suited to easy transport and implementation, in particular because each of the upper support bar and lower support bar are a single piece and therefore of a relatively great length. In its current configuration, the device is bulky, complicated to carry particularly during interventions on upper floors in a building involving risks of shocks on the walls as well as the ramps of the staircases and not easy to place on the door or remove after implementation. This bulk also impairs its packing and transport for carrying it over long distances, because currently the device can only be dissociated into two elements of great length comprising (a) the lower support bar with the jack and the lower sole and (b) the upper support bar with the intermediate sole and the upper support device.

SUMMARY

The aim of the present invention is to supply a device which overcomes these disadvantages. To this end, the present invention supplies a door opening device which can be disassembled into at least 3 parts, manually and without any tooling, which allows easier carrying because it can be divided among several persons if necessary, and with no risk of shocks in staircases during carrying in the upper floors of a building, and finally it can be assembled in a few seconds on the door in question. It can also be packed into a much smaller transport case than that currently used, transportable by a single person.

The present invention supplies a thrust device for opening a door which can be assembled from a ready-to-assemble assembly of at least 3 parts by reversible attachment devices which can be manually activated and deactivated, and able to maintain a rectilinear alignment of the lower and upper parts of the lower and upper support bars.

More precisely, the present invention supplies a thrust device for exerting a thrust on a door or any other flat vertical surface such as a partition, comprising a lower support bar, an intermediate support sole and an upper support bar, and preferably a lower support sole, each of said lower support bar and respectively upper support bar being able to be actuated in telescopic extension, characterized in that the thrust device is able to be assembled from a ready-to-assemble assembly of at least 3 parts comprising two reversible attachment devices which can be manually activated and deactivated, able to accomplish the reversible attachment of the lower and upper parts of each of said lower support bar and respectively upper support bar and able to maintain said lower support bar and upper support bar in rectilinear alignment when they are actuated in said telescopic extension.

Even more particularly, the present invention supplies a thrust device in which:

said lower support bar comprises a lower part comprising a jack, preferably a hydraulic jack, said jack comprising a jack body in which the lower end is preferably attached in a manner articulated in rotation to said lower support sole, and a first jack rod, and an upper part of the lower support bar being attached or able to be attached in a manner articulated in rotation to said intermediate sole, and said upper support bar comprises a lower part attached or able to be attached in a manner articulated in rotation to and relative to said intermediate sole, and an upper part of the upper support bar preferably comprising an upper support device, said upper support bar being able to be actuated in telescopic extension to cause the distance between said lower and upper parts of the upper support bar to vary, characterized in that:

said first jack rod is attached or able to be reversibly attached via a first reversible attachment device to said upper part of the lower support bar, the telescopic actuation of said first jack rod being able to cause the distance between said jack body and said upper part of the lower support bar to vary, said first reversible attachment device, when it is activated, being able to maintain said upper part of the lower support bar in rectilinear alignment with said first jack rod to which it is attached during the telescopic actuation of said first jack rod, said upper support bar comprises or cooperates with a second rod extending at least partially in the interior of said upper support bar, said second rod being manually or electrically activated in said telescopic extension to cause said distance between said lower part and upper part of the upper support bar to vary, said second rod being attached or able to be reversibly attached via a second reversible attachment device to said upper part of the upper support bar, said second attachment device, when it is activated, being able to maintain said second lower part and said upper part of the upper support bar, attached to one another in rectilinear alignment relative to one another during the telescopic actuation of said second rod.

What is meant by "causing the distance between said lower part and upper part of the upper support bar to vary," is that this involves causing the ends of said lower part and upper part of the upper support bar attached or able to be attached to the intermediate sole and respectively said upper support sole to vary, and by "attached in a manner articulated in rotation on and relative to said sole . . . " that this involves articulation in rotation relative to said sole in question.

It is understood that:

said second rod extends partially inside a tubular wall of the upper end of said lower part and partially outside of said upper part of the upper support bar when it is in said telescopic extension; and the attachment of said upper part of the lower support bar in rectilinear alignment with said first movable rod of the jack, allows a variation of the distance [between] said upper part of the lower support bar and said jack body during the telescopic actuation of said first jack body, and the attachment of said second rod in rectilinear alignment with said upper part of the upper support bar, via said second reversible attachment, allows a variation of the distance between said intermediate sole to which the lower part of the upper support bar is attached [text missing] articulation in rotation and said upper part of the upper support bar, during the telescopic actuation of said second rod, and when said first jack rod is separated from said upper part of the lower support bar by deactivation of said first reversible attachment device, and said section rod is separated from said upper part of the upper support bar by deactivation of said second reversible attachment device, said thrust device is able to be stored in at least 3 independent parts, preferably with substantially the same length, comprising said upper part of the lower support bar and said lower part of the upper support bar remaining attached to a said intermediate sole, being able to fold against one another longitudinally, separated from said jack and respectively from said upper part of the upper support bar, preferably with substantially the same length.

Still more particularly, said first attachment device comprises an upper terminal part of said first jack rod able to cooperate and be reversibly attached to a complementary lower terminal part of said upper part of the lower support bar.

More particularly still, said first attachment device comprises a said upper terminal part of said first jack rod with a male shape, preferably outside said jack body when said first jack rod is in the retracted position, able to engage and be reversibly attached in a said complementary lower terminal part with a female shape such as a first cavity of said upper part of the lower support bar.

More particularly still, said upper terminal part of the first jack rod and said first cavity are of complementary cylindrical shapes able to enter into one another for activating said first attachment device and deactivate it under manual control, and with the same length d1 sufficient to maintain said rectilinear alignment, preferably with a smaller diameter than that of said first jack rod.

In another embodiment, said first attachment device comprises an upper terminal part of said first jack rod in the form of a cavity able to receive and be reversibly attached to a said lower terminal part with a male shape complementary to said upper part of the lower support bar.

Preferably, said first jack rod comprises two telescopic elements. It is understood that said upper terminal part of the first jack rod is at the end of the rod element farthest away from the jack body when the jack rod extended. This embodiment is advantageous, because it allows the jack body to have a shorter length while still being able to receive the retracted jack rod inside the jack body and offers safety with regard to the risk of buckling of the jack rod when the thrust device is implemented.

Still more particularly, said second attachment device comprises an upper terminal part of said second rod able to cooperate and be reversibly attached to a complementary lower terminal part of said upper part of the upper support bar.

More particularly still, said second attachment device comprises a said upper terminal part of said second rod, preferably with a smaller diameter than that of said second rod, able to engage and be reversibly attached in a second cavity at the lower end of said upper part of the upper support bar.

More particularly still, said upper terminal part of the second rod and said second cavity are of complementary cylindrical shapes able to enter into one another for activating said second attachment device and deactivate it under manual control and with the same length d2 sufficient to maintain said rectilinear alignment.

In another embodiment, said second attachment device comprises a said upper terminal part of said second rod in the form of a cavity able to receive and be reversibly attached to a complementary male terminal part at the lower end of said upper part of the upper support bar.

More particularly still, said second rod comprise a thread which is able to cooperate with a peripheral wheel through which said second rod passes, such that the manual rotation of said wheel causes said relative sliding of said second rod relative to said lower part of the upper support bar.

In practice an endless screw or ball screw system is implemented, which allows transforming a rotation movement into a sliding movement.

Still more particularly, one at least of said first or second attachment device comprises:

a) a first or respectively second transverse locking finger able to cooperate with a first or respectively second spring at the bottom of a first or respectively second hollow recess at said upper terminal part of the first or respectively second rod, said first or respectively second locking finger being able to retract by compression of said first or respectively second spring when said first or respectively second rod begins to enter into said first or respectively second cavity, and said first or respectively second locking finger being able to engage into a first or respectively second opening in the tubular wall of said first or respectively second cavity, by extension of said first or respectively second spring when said terminal part of said first or respectively second rod is completely engaged in said first or respectively second cavity for activating said first or respectively second reversible attachment device, b) a first or respective second unlocking pushbutton disposed inside said first or respectively second opening in the tubular wall of said first or respectively second cavity, said first or respectively second unlocking pushbutton being able to be manually controlled to push in and retract said first or respectively second transverse locking finger by compression of said or respectively second spring at the bottom of said first or respectively second hollow recess, for deactivating said first or respectively second reversible attachment device.

In one embodiment, said upper support device is attached in an articulated manner, preferably in a detachable manner, to the upper end of said upper support bar, said upper support device comprising at least one spacing and blocking part able to allow the opening of a pulling door.

More particularly, one at least of said lower sole and intermediate sole comprises a flat support one face of which is intended to be supported on the ground or respectively said door or flat vertical surface, comprising anti-skid elements, preferably hard points, and the other face of which comprises articulation means to which are attached articulated attachment means.

More particularly still, said intermediate and lower soles comprise a flat support and articulation means consisting of yokes on one face of said flat supports, yokes on which are mounted, preferably removably, hinge pins forming articulation axes in bores in said yokes and said ends of said first extension bar and second extension bar, thus allowing their articulation on said soles.

Still more particularly, the thrust device according to the invention comprises:

a hydraulic unit delivering a pressure, preferably of at least 250 bars, also preferably mounted on a chassis portable on the back of an operator, and said hydraulic unit preferably being connected by a single flexible line to a single-acting hydraulic jack, more preferably by means of a knob allowing opening and closing control of the supply valves and the hydraulic fluid return of said single-acting hydraulic jack.

The present invention also supplies a ready-to-assemble assembly (or kit) for forming a thrust device according to the invention, when said first jack rod is detached from said upper part of the lower support bar by deactivation of said first reversible attachment device, and said second rod is detached from said upper part of the upper support bar by deactivation of said second reversible attachment device, said assembly comprising at least 3 independent parts, preferably with substantially the same length, comprising:

(1) a first part comprising said lower part of the lower support bar comprising said jack of which the jack body is preferably attached or able to be attached in a manner articulated in rotation to said lower support sole, said first jack rod is in the retracted position in the interior of the jack body (2) a second part comprising:

(a) said upper part of the lower support bar attached in a manner articulated in rotation to said intermediate sole, and (b) said lower part of the upper support bar attached in a manner articulated in rotation to said intermediate sole, said second rod being entered at least partially into the interior of a tubular termination of said lower part of the upper support bar, and (c) said upper part of the lower support bar and said lower part of the upper support bar, being actuated in rotation relative to said intermediate sole so as to be situated one against the other or facing one another in a substantially parallel manner, and (3) a third part comprising said upper part of the upper support bar, preferably comprising a said upper support device.

The thrust device, disassembled in this manner, is able to be stored in a case of reduced size.

The present invention also supplies a method for exerting a thrust, preferably of at least 50 kN, on a door or other flat vertical surface based on external anchorages, characterized in that a thrust device according to the invention is used, preferably based on a ready-to-assemble assembly according to the invention.

Still more particularly, steps are carried out in which:

a) said lower support bar is disposed with said jack in the retracted position, preferably inclined by 20 to 35° relative to the vertical, with said intermediate sole supported on said door or flat vertical surface, preferably in proximity to a lock or door knob or the hinges of said door, said jack being in the retracted position supported on a lower external anchorage, preferably the ground, preferably by means of a said lower sole, said upper support bar being actuated in said telescopic extension to be supported against an upper external anchorage, preferably a lintel of the frame of a door or a ceiling or a flat horizontal surface situated above said flat vertical surface, and b) the first movable rod of said jack is operated in extension so as to exert a said thrust on said intermediate sole.

Still more particularly, the following steps are implemented in which:

before step a), the assembly between the lower part and the upper part of the lower support bar, and between the lower part and the upper part of the upper support bar is carried out by manually activating said first and second attachment devices before placing said lower support bar and respective upper support bar in position against the door, and after step b), said first and second attachment devices are deactivated to respectively separately store said lower part of the lower support bar and said upper part of the upper support bar.

More particularly still, a thrust is exerted on a reinforced door to force its opening by exerting a thrust on said intermediate sole until an increase in the inclination of said jack by at least 3°, preferably an increase of 5 to 20°, is obtained.

BRIEF DESCRIPTION OF THE DRAWINGS

Other features and advantages of the present invention will be better revealed upon reading the description that follows, not limiting and made in an illustrative manner, with reference to the appended drawings in which.

DETAILED DESCRIPTION OF VARIOUS EMBODIMENTS

Figure 1:
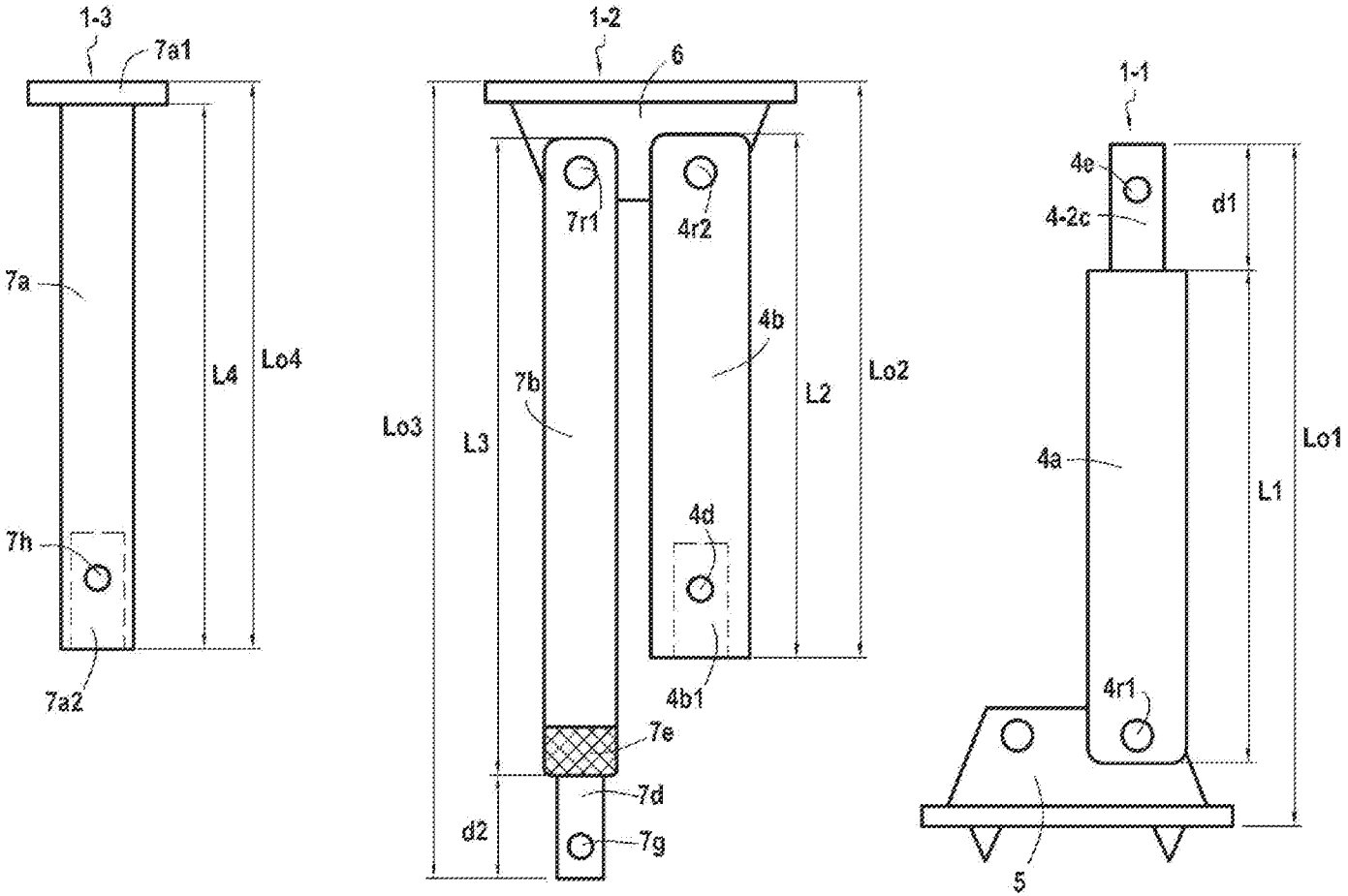
FIG. 1 shows the thrust device according to the invention disassembled into 3 independent separate parts.

The disassembled thrust device according to the invention, as shown in FIG. 1, comprises 3 independent parts 1-1, 1-2, 1-3, with lengths L01, L02 and L03 not exceeding L03=750 mm, comprising:

(1) a first part 1-1 comprising a lower part 4*a* of the lower support bar 4 comprising a jack, of which the jack body 4-1, attached on the side of its lower end to a lower support sole 5 able to rest on the ground 10 by a device for articulation in rotation 4*r*1, the first telescopic jack rod 4-2 being in the maximum retraction position inside the jack body so that only an upper terminal part 4-2*c* of the jack rod extends beyond the jack body by a distance d1 of approximately 100 mm, and (2) a second part (1-2) comprising:

(a) an upper part 4*b* of the lower support bar 4 attached at one end by a device for articulation in rotation 4*r*2 to said intermediate sole 6 and the other end of which contains a first cavity (not visible in FIG. 1) able to receive said upper terminal part 4-2*c* of the jack rod and to attach itself to it by a first reversible attachment device explained hereafter, and (b) the lower tubular part 7*b* of the upper support bar 7 attached at one end by a device for articulation in rotation 7*r*1 to said intermediate sole 6, a second telescopic rod 7*c* being entered as far as possible into the interior of said lower tubular part 7*b* by actuation in rotation as described hereafter by means of a wheel 7*e* disposed at the other end of said lower tubular part 7*b*, of which only a terminal part 7*d* with a length d2 of approximately 100 mm of said second rod extends past said lower tubular part 7*b*, and (c) said upper part 4*b* of the lower support bar 4 and said lower part 7*b* of the upper support bar 7, here being actuated in rotation relative to said intermediate sole so as to be located disposed one against the other in a substantially parallel manner, and (3) a third part 1-3 comprising an upper part 7*a* of the upper support bar 7 comprising, at its upper end, an upper support device 7*a*1 and in its lower terminal part a second cavity (not visible in FIG. 1) able to receive said terminal part 7*d* of said second jack rod and attach itself to it by a second reversible attachment device explained hereafter.

Figure 2A:
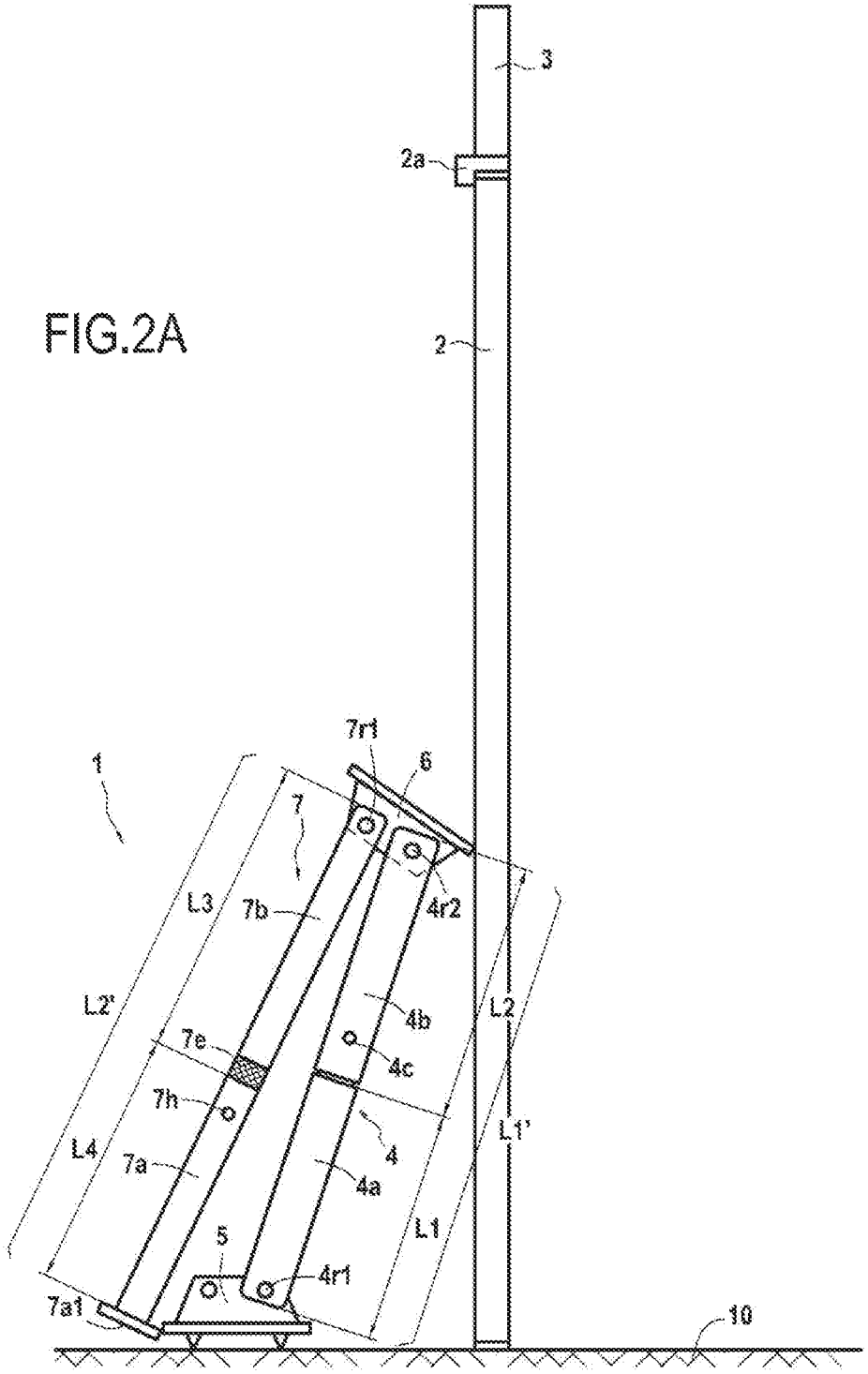
FIGS. 2A and 2B show the thrust device according to the invention assembled with said lower anchorages 4 and upper support bar 7 disposed against one another (FIG. 2A) and in position against the door (FIG. 2B)
Figure 2B:
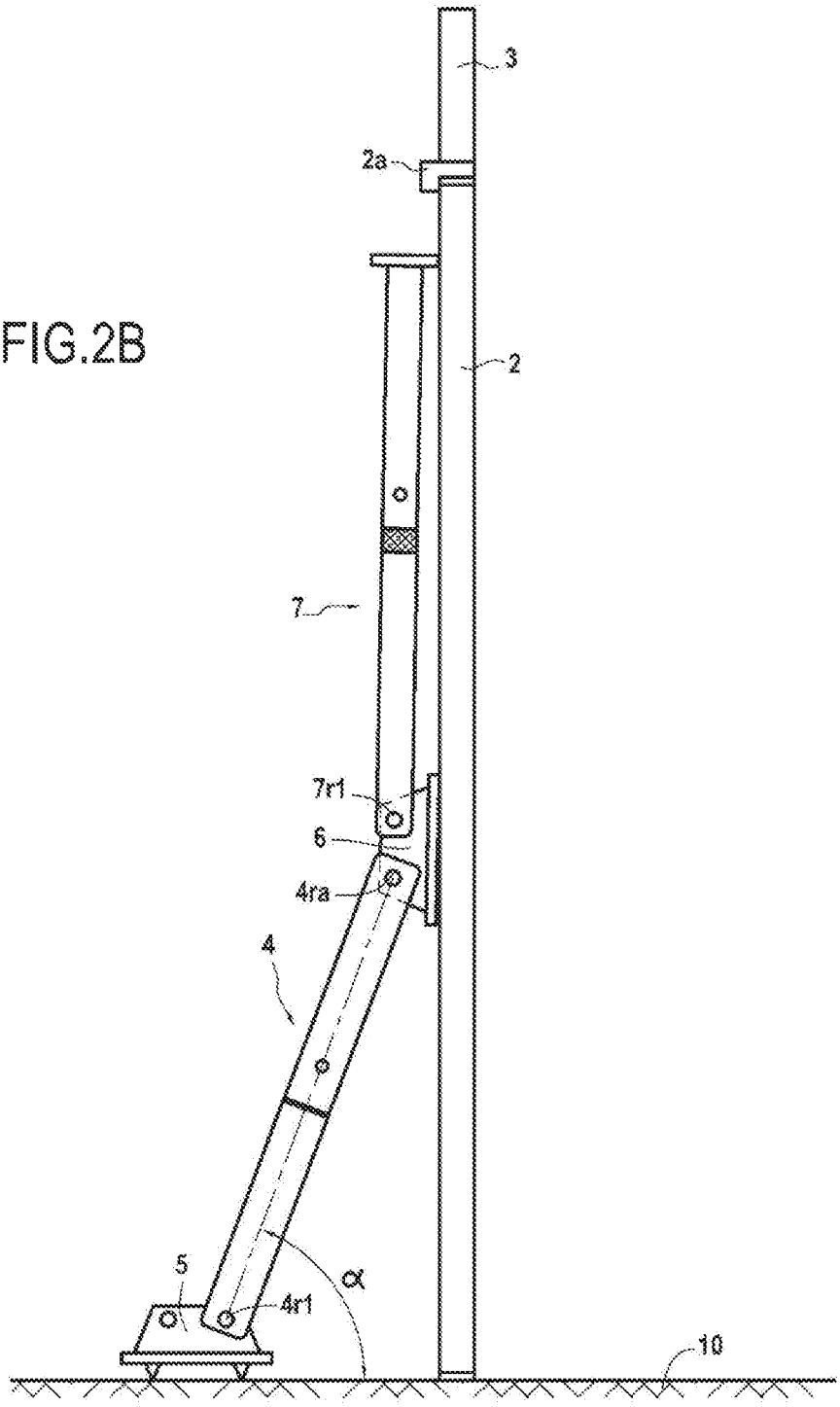

In FIGS. 2A and 2B, the thrust device according to the invention is shown assembled with said lower support bar 4 and upper support bar 7, assembled and disposed folded against one another (FIG. 2A) and deployed in rotation with the intermediate sole 6 supported against the door 2, the lower support bar 4 inclined by an angle of approximately $\alpha$=20 to 35° relative to the horizontal from the lower sole 5 supported on the ground 10, and the upper support bar 7 vertical against the door (FIG. 2B), said first and second rods being in the maximally retracted position, each assembled bar 4 and 7 has a length L1'=L1+L2 and respectively L2'=L3+L4 of no more than 1500 mm.

Figure 3A:
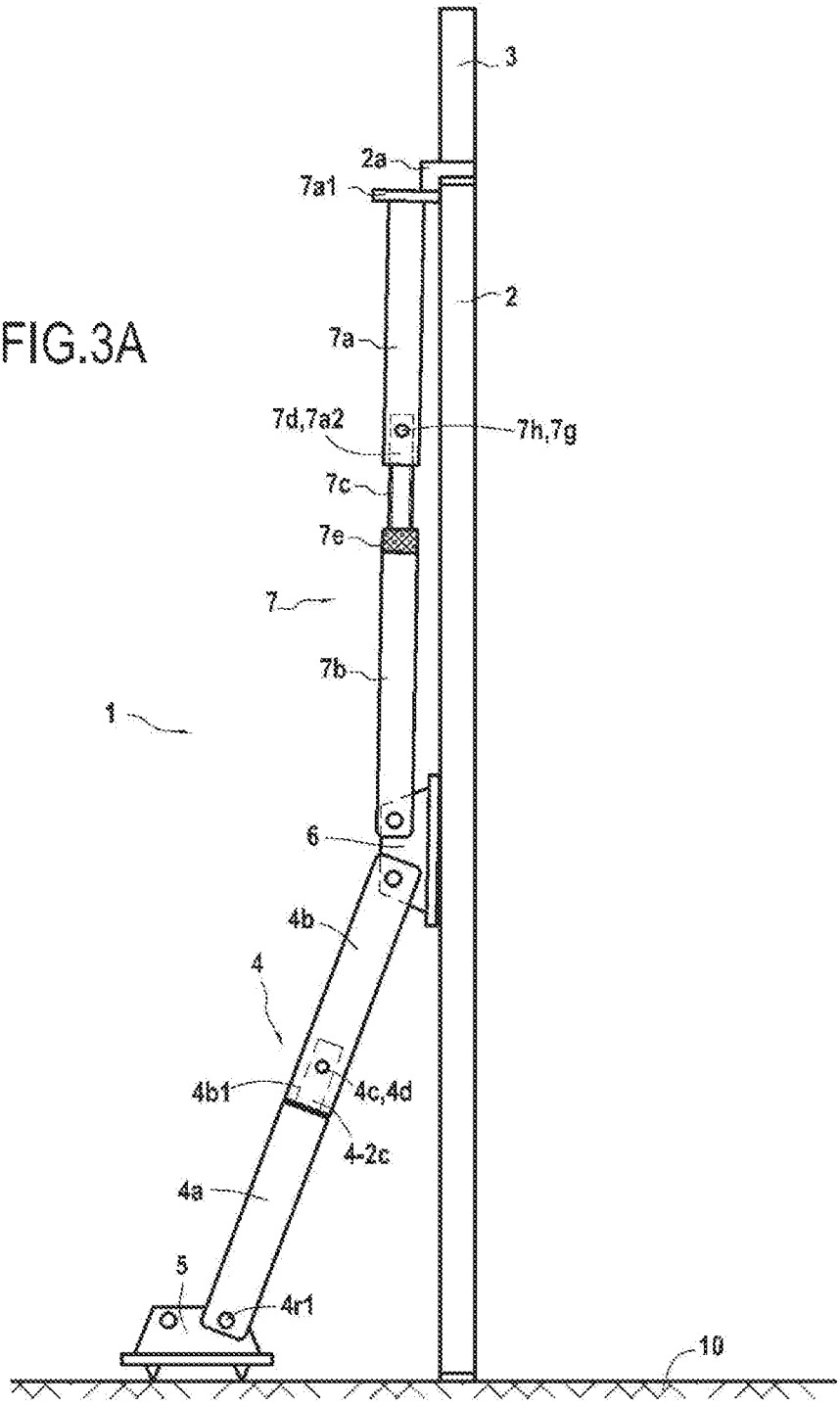
FIGS. 3A and 3B show the thrust device according to the invention applied to the door ready to exert a thrust (FIG. 3A), and while thrusting (FIG. 3B)
Figure 3B:
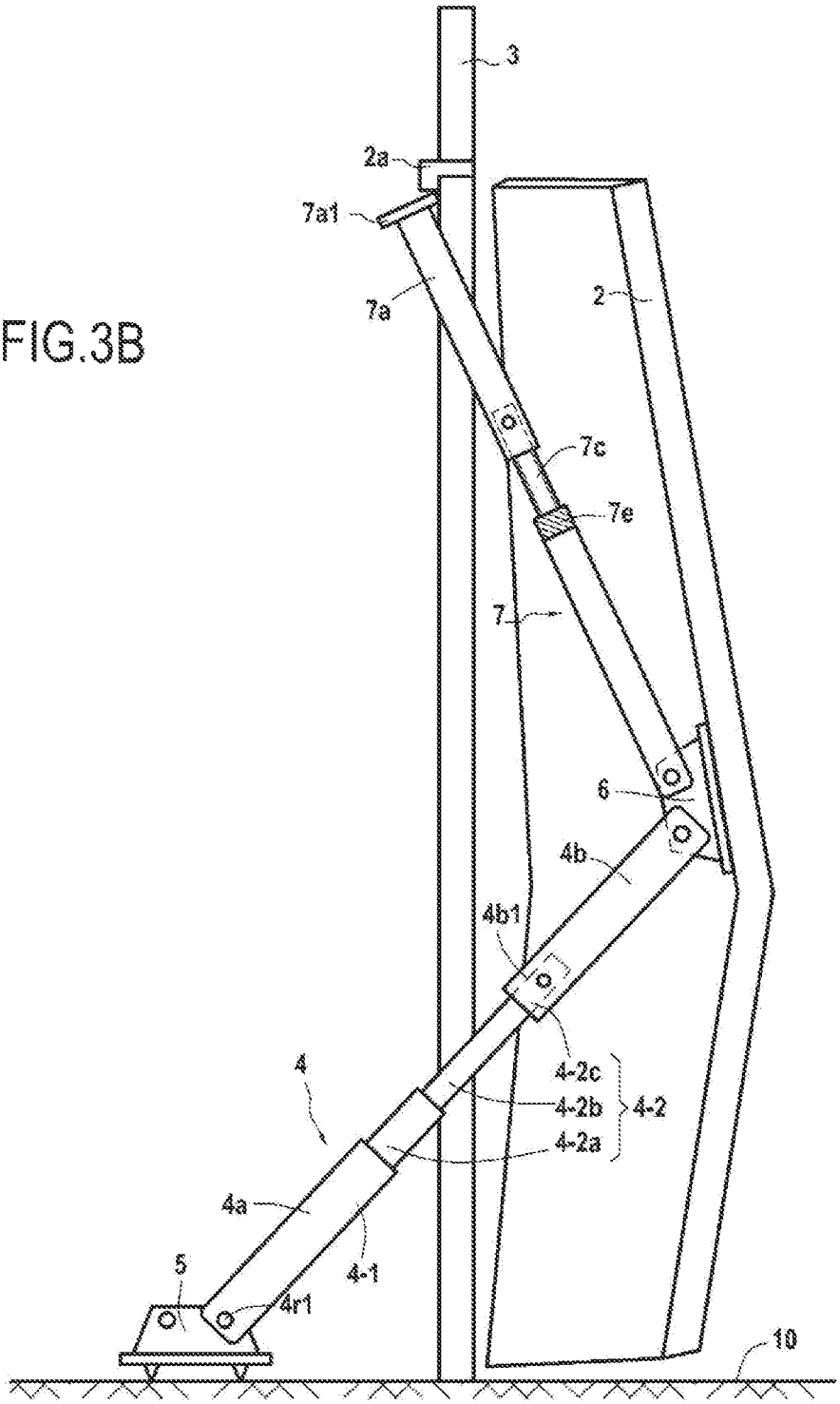

In FIGS. 3A and 3B, the thrust device 1 according to the invention is shown assembled and applied to the door, ready to exert a thrust with said first rod still in the retracted position and said second rod 7*c* in the extended position to block the upper support device 7*a*1 at the upper end of the upper support bar 7 against the lintel 2*a* of the door (FIG. 3A), and during thrusting with said first rod 4-2 in the extended position and the second rod 7*c* in the extended position (FIG. 3B).

FIGS. 4A-4B and 5A-5C allow a better description of the structure and the operation of the thrust device 1 of the invention.

Figure 4A:
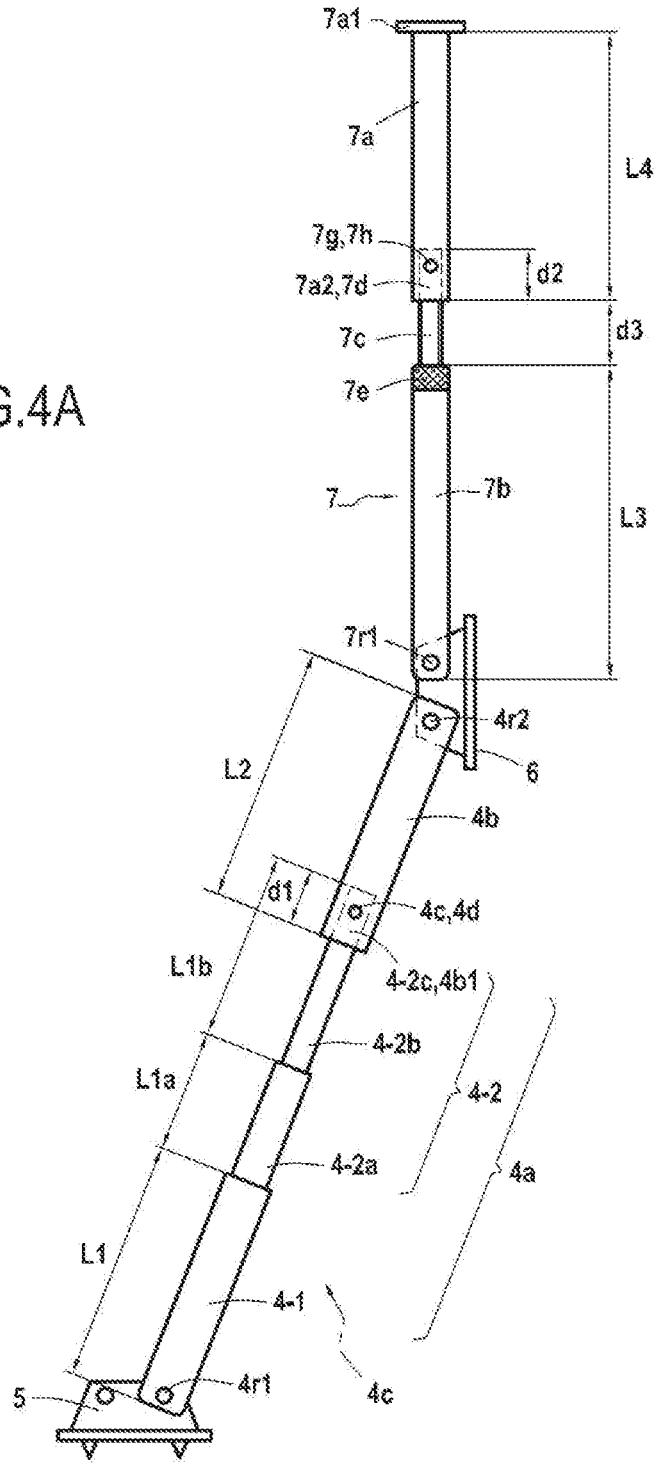
FIGS. 4A and 4B show the thrust device according to the invention with said first rod 4-2 in the maximum extension position and the second rod 7*c* in the maximum extension position, the device being assembled (FIG. 4A) and with the 3 parts 1-1, 1-2 and 1-3 disassembled (FIG. 4B)

In FIG. 4A, the jack rod 4-2 is shown in maximum extension, itself consisting of two telescopic elements 4-2*a* and 4-2*b* with lengths L1*a* and L1*b* such that L1*a*+L1*b* is greater than L1, the length of the jack body, with L1*a* and L1*b* less than L1. The upper terminal part 4-2*c* is disposed at the end of the second element 4-2*b* of the jack rod 4-2.

Figures 5A, 5B, 5C:
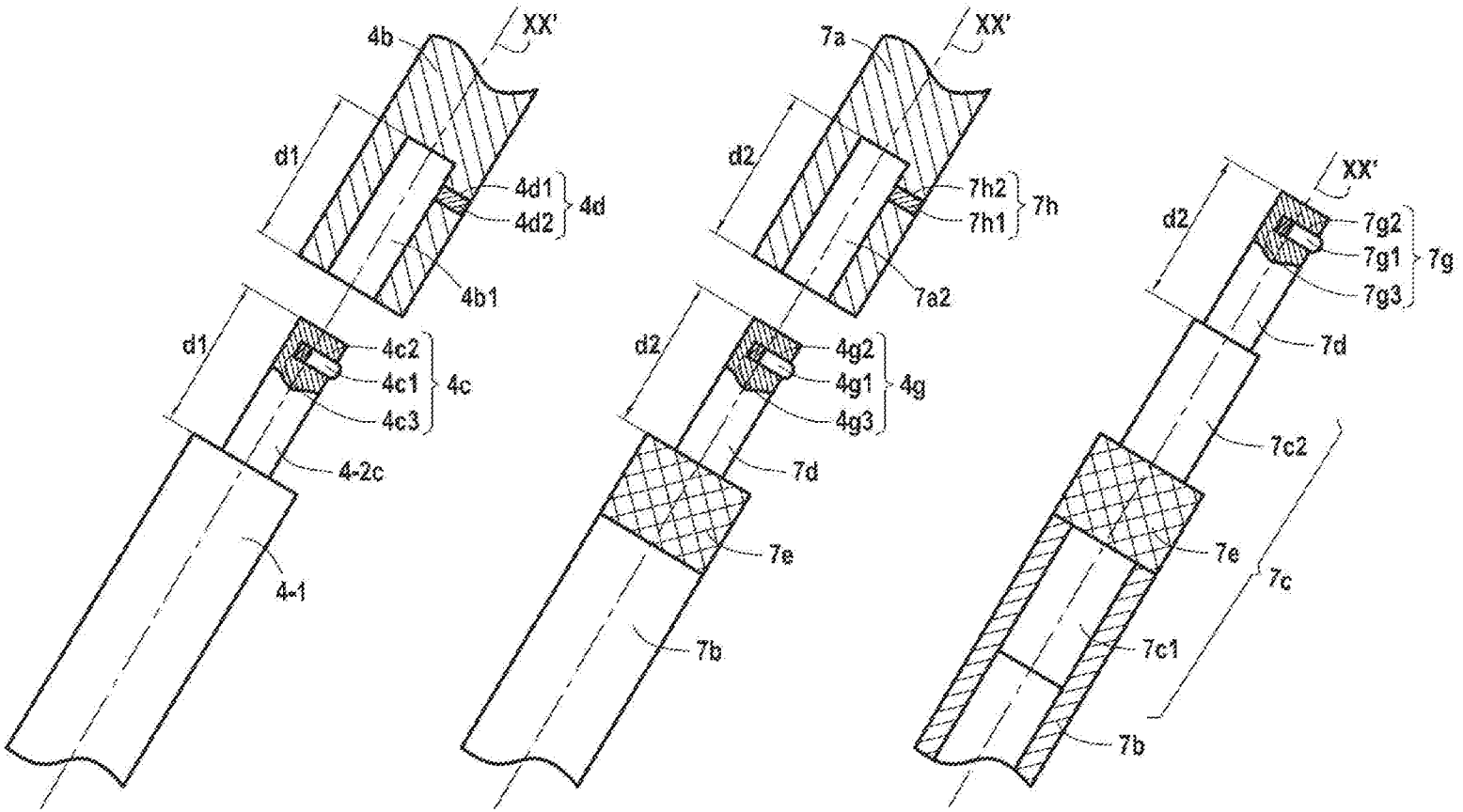
FIGS. 5A and 5B show the detail of the first attachment device (FIG. 5A) and of the second attachment device (FIG. 5B)
FIG. 5C shows the schematic detail in longitudinal section of the lower tubular part 7*b* of the upper support bar 7 with the second rod 7*c*.

FIG. 5A shows the detail of the first attachment device, the jack 4 being in the retracted position with only the terminal part 4-2*c*, with a smaller diameter than the second jack rod element 4-2*b* extending outside the jack body 4-1. The terminal part 4-2*c* has a diameter and a length d1 substantially identical to those of the first cylindrical cavity 4*b*1 at the lower end of the upper part 4*b* of the lower support bar.

The first attachment device 4*c*, 4*d* between the first rod 4-2 and the upper part 4*b* of the lower support bar 4 comprises:

a) a first transverse locking finger 4*c*1 able to cooperate with a first spring 4*c*2 at the bottom of a first hollow recess 4*c*3 in said upper terminal part 4-2*c* of the first rod 4-2, said first locking finger 4*c*1 being able to retract by compression of said first spring 4*c*2 when said first rod 4-2 begins to enter into said first cavity, and said first locking bar 4*c*1 being able to engage in a first opening 4*d*2 in the tubular wall of said first cavity 4*b*1, by elastic extension of said first spring 4*c*2 when said terminal part 4-2*c* of the first rod 4-2 is completely engaged in said first cavity 4*b*1 for activating said first reversible attachment device, b) a first unlocking pushbutton 4*d*1 disposed inside said first opening 4*d*2 in the tubular wall of said first cavity 4*b*1, said first unlocking pushbutton 4*d*1 being able to be manually controlled to insert and retract said first transverse locking finger 4*c*1 by compression of said first spring 4*c*2 at the bottom of said first hollow recess 4*c*3, for deactivating said first reversible attachment device and thus be able to remove the terminal part 4-2*c* of the jack rod outside of the first cavity 4*b*1.

Figure 4B:
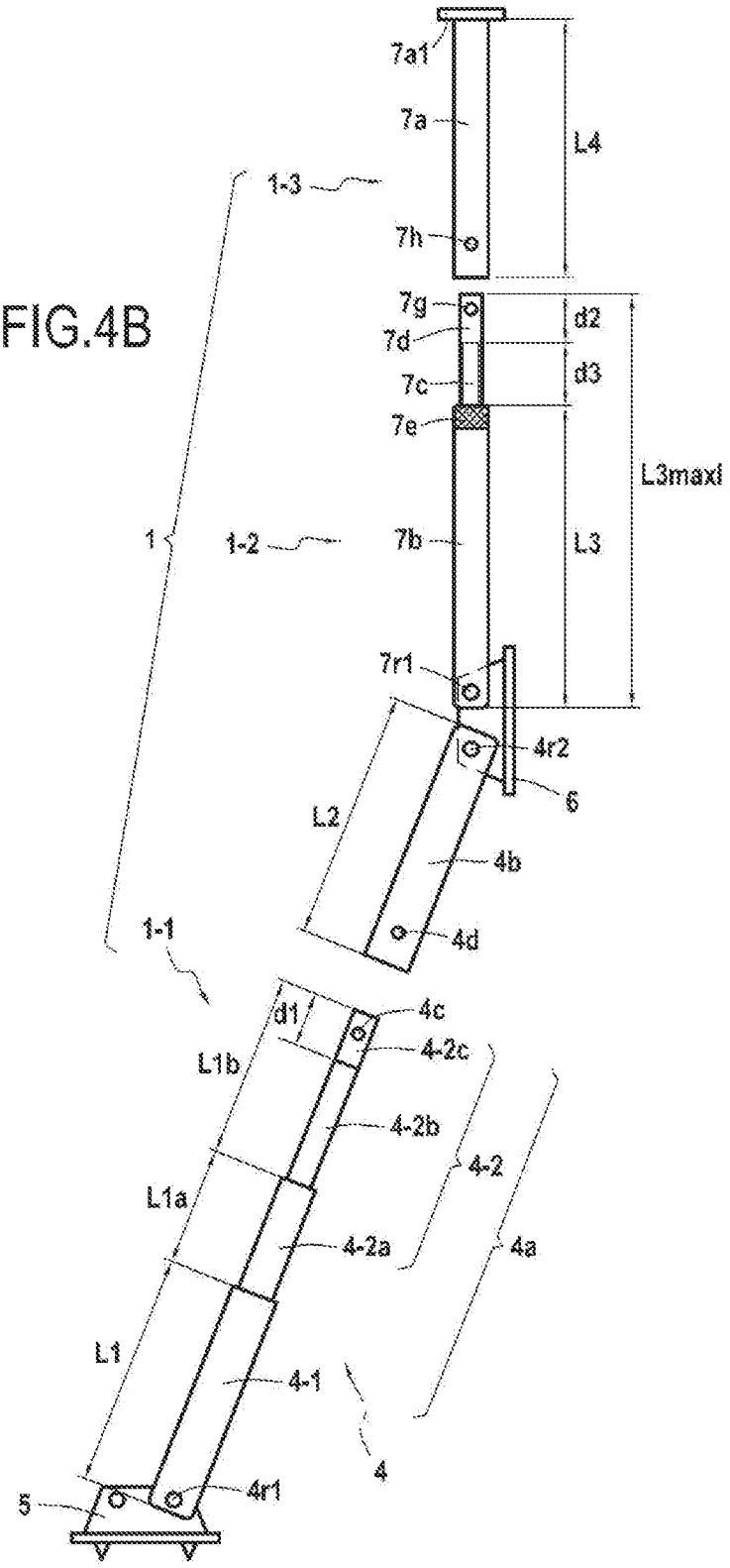

In FIG. 4B, the thrust device according to the invention is shown with said second rod 7*c* in the maximum extended position with its upper terminal part 7*d* with length d2, with a smaller diameter than the second rod 7*c*. In FIGS. 5B and 5C, the threading of the second rod 7*c* is shown, and an annular wheel 7*e* that can be actuated in rotation relative to the longitudinal axis XX' of the upper support bar 7, disposed at the upper end of the tubular wall of the lower part 7*b* of the upper support bar 7 to form a ball screw system with the second threaded rod 7*c*. The threading of the second rod 7*c* cooperates with the wheel 7*e* so that a manual rotation command of the wheel 7*e* causes sliding in longitudinal translation along the axis XX' of the second rod partially 7*c*1 inside the tubular wall 7*b* and through the wheel 7*e* to extend partially 7*c*2 over a length d3 outside the lower tubular part 7*b*. In FIG. 5B, the second rod 7*c* is in the maximum retracted position with only the upper terminal part 7*d* extending out of the lower tubular part 7*b* of the upper support bar.

FIGS. 5B and 5C show the detail of the second attachment device 7*g*, 7*h* between the terminal part 7*d* of the second rod 7*c* and the second cylindrical cavity 7*a*2 at the lower end of the upper part 7*a* of the upper support bar with substantially identical diameter and length d2. The second attachment device 7*g*, 7*h* comprises:

a) a second transverse locking finger 7*g*1 able to cooperate with a second spring 7*g*2 at the bottom of a second hollow recess 7*g*3 in the upper terminal part 7*d* of the second rod 7*c*, said second locking finger 7*g*1 being able to retract by compression of said second spring 7*g*2 when said second rod 7*c* begins to enter into said second cavity 7*a*2, and said second locking finger 7*g*1 being able to engage into a second opening 7*h*2 in the tubular wall of said second cavity, by extension of said second spring 7*g*2 when said terminal part 7*d* of said second rod 7*c* is completely engaged in said second cavity for activating said second reversible attachment device, b) a second unlocking pushbutton 7*h*1 disposed inside said second opening 7*h*2 in the tubular wall of said second cavity, said second unlocking pushbutton 7*h*1 being able to be manually controlled for inserting and retracting said second transverse locking finger 7*g*1 by compression of said second spring 7*g*2 at the bottom of said second hollow recess 7*g*3, for deactivating said second reversible attachment device and thus be able to remove the terminal part 7*d* of the second rod 7*c* outside of the second cavity 7*a*2.

Figure 6A:
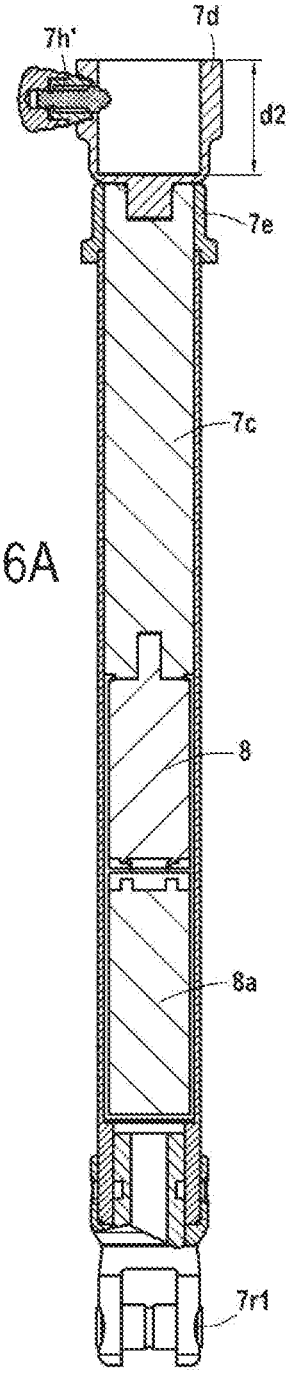
FIGS. 6A and 6B show separately the lower part 7*b* (FIG. 6A) and the upper part 7*a* (FIG. 6B) of another embodiment of the upper support bar 7, with another embodiment of the second reversible attachment device.

In FIG. 6A, the lower part 7*b* of another embodiment of the upper support rod 7 is shown, with a said upper terminal part 7*d* in the form of a cavity and the second rod 7*c* in the retracted position inside the tubular wall of the lower part 7*b* of the upper support bar 7. The sliding of the second rod 7*c* being able to be controlled by an electric motor 8 supplied by a battery 8*a* disposed inside the tubular wall of the lower part 7*b* of the upper support bar 7. The motor 8 is disposed below the second rod 7*c*, which the engine 8 is able to cooperate so as to be able to turn the screw which is consists of the second rod 7*c*, causing its relative translation by sliding relative to the wheel 7*e* with which it cooperates. In the event of failure of the electric motor or of the battery, it remains possible to manually actuate the wheel 7*e* in rotation for turning the second rod 7*c*, causing its relative translation by sliding.

Figure 6B:
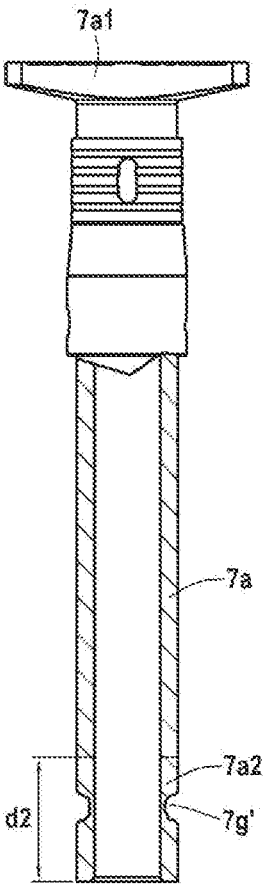

Shown in FIG. 6B is the upper part 7*a* of said other embodiment of the upper support bar 7, the lower terminal part 7*a*2 is able to engage into the cavity of said upper terminal part 7*d* the lower part 7*b* of FIG. 6A.

Figure 7A:
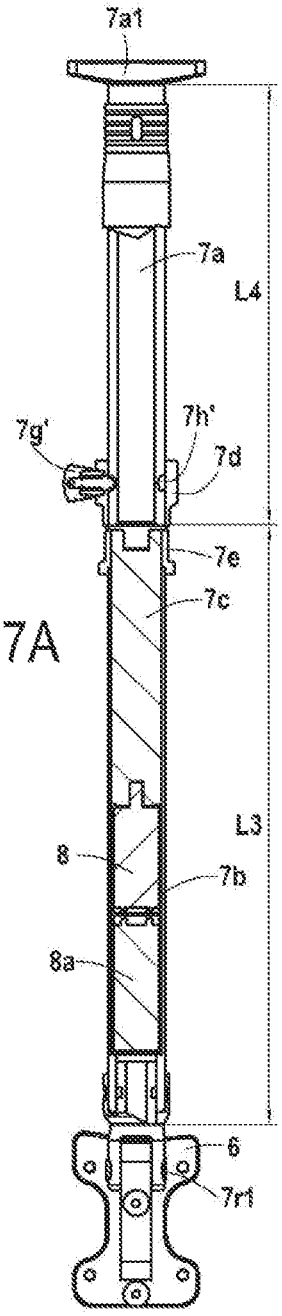
FIGS. 7A and 7B show the lower part 7*b* and the upper part 7*a* of the upper support bar 7 of FIG. 6A-6B, assembled to one another.
Figure 7B:
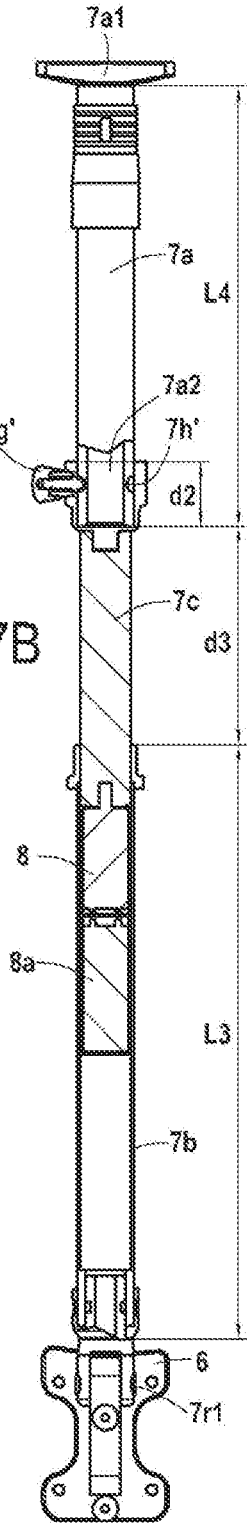

In FIGS. 7A and 7B is shown another embodiment of the second reversible attachment device 7*h*', 7*g*' between (1) the lower terminal part 7*a*2 of the upper part 7*a* of said other embodiment of the upper support bar 7 and (2) the upper terminal part 7*d* in the form of a cavity of the second rod 7*c*. The lower terminal part 7*a*2 comprises a hollow annular groove 7*g*' able to receive the end of a locking finger 7*h*'. The finger 7*h*' cooperates with an elastic means in an opening in the tubular wall of the cavity 7*d* so that the finger engages in the groove 7*g*' when the terminal part 7*a*2 is engaged in a complementary manner in the cavity 7*d*. And, by pulling on the finger 7*h*', it can be removed from the groove 7*g*', which allows removing the terminal part 7*a*2 outside the cavity 7*d*.

The invention claimed is:

1. A thrust device for exerting a thrust on a door or any other flat vertical surface such as a partition, comprising a lower support bar, an intermediate support sole and an upper support bar, and a lower support sole, each of said lower support bar and respectively upper support bar being able to be actuated in telescopic extension, wherein the thrust device is able to be assembled from a ready-to-assemble assembly of at least three parts by two reversible attachment devices, which can be manually activated and deactivated, able to accomplish the reversible attachment of the lower and upper parts of each of said lower support bar and respectively upper support bar and able to maintain said lower support bar and upper support bar in rectilinear alignment when they are actuated in said telescopic extensions, wherein:

said lower support bar comprises a lower part comprising a jack, a hydraulic jack, said jack comprising a jack body in which the lower end is attached in a manner articulated in rotation to said lower support sole, and a first jack rod, and an upper part of the lower support bar being attached or able to be attached in a manner articulated in rotation to said intermediate sole, said upper support bar comprises a lower part attached or able to be attached in a manner articulated in rotation to and relative to said intermediate sole, and an upper part of the upper support bar comprising an upper support device, said upper support bar being able to be actuated in telescopic extension to cause the distance between said lower and upper parts of the upper support bar to vary, wherein:

said first jack rod is attached or able to be reversibly attached via a first reversible attachment device to said upper part of the lower support bar, the telescopic actuation of said first jack rod being able to cause the distance between said jack body and said upper part of the lower support bar to vary, said first reversible attachment device, when it is activated, being able to maintain said upper part of the lower support bar in rectilinear alignment with said first jack rod to which it is attached during the telescopic actuation of said first jack rod, said upper support bar comprises or cooperates with a second rod extending at least partially in the interior of said upper support bar, said second rod being manually or electrically activated in said telescopic extension to cause said distance between said lower part and upper part of the upper support bar to vary, said second rod being attached or able to be reversibly attached via a second reversible attachment device to said upper part of the upper support bar, said second attachment device, when it is activated, being able to maintain said second lower part and said upper part of the upper support bar, attached to one another in rectilinear alignment relative to one another during the telescopic actuation of said second rod.

2. The thrust device according to claim 1, wherein said first attachment device comprises an upper terminal part of said first jack rod able to cooperate and be reversibly attached to a complementary lower terminal part of said upper part of the lower support bar.

3. The thrust device according to claim 2, wherein said first attachment device comprises a said upper terminal part of said first jack rod with a male shape, outside said jack body when said first jack rod is in the retracted position, able to engage and be reversibly attached in a said complementary lower terminal part with a female shape such as a first cavity of said upper part of the lower support bar.

4. The thrust device according to claim 3, wherein one at least of said first or second attachment device comprises:

a) a first or respectively second transverse locking finger able to cooperate with a first or respectively second spring at the bottom of a first or respectively second hollow recess at said upper terminal part of the first or respectively second rod, said first or respectively second locking finger being able to retract by compression of said first or respectively second spring when said first or respectively second rod begins to enter into said first or respectively second cavity, and said first or respectively second locking finger being able to engage into a first or respectively second opening in the tubular wall of said first or respectively second cavity, by extension of said first or respectively second spring when said terminal part of said first or respectively second rod is completely engaged in said first or respectively second cavity for activating said first or respectively second reversible attachment device, b) a first or respective second unlocking pushbutton disposed inside said first or respectively second opening in the tubular wall of said first or respectively second cavity, said first or respectively second unlocking pushbutton being able to be manually controlled to push in and retract said first or respectively second transverse locking finger by compression of said or respectively second spring at the bottom of said first or respectively second hollow recess, for deactivating said first or respectively second reversible attachment device.

5. The thrust device according to claim 3, wherein said upper terminal part of the first jack rod and said first cavity are of complementary cylindrical shapes able to enter into one another for activating said first attachment device and deactivate it under manual control, and with the same length d1 sufficient to maintain said rectilinear alignment, with a smaller diameter than that of said first jack rod.

6. The thrust device according to claim 1, wherein said first jack rod comprises two telescopic elements.

7. The thrust device according to claim 1, wherein said second attachment device comprises an upper terminal part of said second rod able to cooperate and be reversibly attached to a complementary lower terminal part of said upper part of the upper support bar.

8. The thrust device according to claim 7, wherein said second attachment device comprises a said upper terminal part of said second rod, with a smaller diameter than that of said second rod, able to engage and be reversibly attached in a second cavity at the lower end of said upper part of the upper support bar.

9. The thrust device according to claim 8, wherein said upper terminal part of the second rod and said second cavity are of complementary cylindrical shapes able to enter into one another for activating said second attachment device and deactivate it under manual control and with the same length d2 sufficient to maintain said rectilinear alignment.

10. The thrust device according to claim 1, wherein said second rod comprises a thread which is able to cooperate with a peripheral wheel through which said second rod passes, such that the manual rotation of said wheel causes said relative sliding of said second rod relative to said lower part of the upper support bar.

11. A ready-to-assemble assembly for forming a thrust device according to claim 1, comprising at least 3 independent parts, with substantially the same length, comprising:

(1) a first part comprising said lower part of the lower support bar comprising said jack of which the jack body is attached or able to be attached in a manner articulated in rotation to said lower support sole, said first jack rod is in the retracted position in the interior of the jack body (2) a second part comprising:

(a) said upper part of the lower support bar attached in a manner articulated in rotation to said intermediate sole, and (b) said lower part of the upper support bar attached in a manner articulated in rotation to said intermediate sole, said second rod being entered at least partially into the interior of a tubular termination of said lower part of the upper support bar, and (c) said upper part of the lower support bar and said lower part of the upper support bar, being actuated in rotation relative to said intermediate sole so as to be situated one against the other or facing one another in a substantially parallel manner, and (3) a third part comprising said upper part of the upper support bar comprising a said upper support device.

12. A method for exerting a thrust, of at least 50 kN, on a door or other flat vertical surface based on external anchorages, wherein an assembly according to claim 11 is used.

13. The method according to claim 12, wherein steps are carried out wherein:

a) said lower support bar is disposed with said jack in the retracted position, inclined by 20 to 35° relative to the vertical, with said intermediate sole supported on said door or flat vertical surface, said jack being in the retracted position supported on a lower external anchorage, the ground, by means of a said lower sole, said upper support bar being actuated in said telescopic extension to be supported against an upper external anchorage, a lintel of the frame of a door or a ceiling or a flat horizontal surface situated above said flat vertical surface, and b) said first movable rod of said jack is operated in extension so as to exert a said thrust on said intermediate sole.

14. The method according to claim 13, wherein the following steps are implemented wherein:

before step a), the assembly between the lower part and the upper part of the lower support bar, and between the lower part and the upper part of the upper support bar is carried out by manually activating said first and second attachment devices before placing said lower support bar and respective upper support bar in position against the door, and after step b), said first and second attachment devices are deactivated to respectively separately store said lower part of the lower support bar and said upper part of the upper support bar.

* * * * *